US005249927A

United States Patent [19]

Vera

[11] Patent Number: 5,249,927

[45] Date of Patent: Oct. 5, 1993

[54] PROFILED ANNULAR HOOP FOR A FAN HELIX AND ITS APPLICATION TO VEHICLE MOTORIZED FANS

[75] Inventor: Jean-Claude Vera, Valentigney, France

[73] Assignee: ECIA, France

[21] Appl. No.: 972,901

[22] Filed: Nov. 6, 1992

[30] Foreign Application Priority Data

Nov. 7, 1991 [FR] France ..... 91 13754

[51] Int. Cl.[5] ..... F04D 29/08

[52] U.S. Cl. ..... 416/189; 415/228; 415/914

[58] Field of Search ..... 415/228, 914; 416/189

[56] References Cited

U.S. PATENT DOCUMENTS

| | | | |
|---|---|---|---|
| 2,779,424 | 1/1957 | Lyon . | |
| 3,937,192 | 2/1976 | Longhouse | 415/914 |
| 4,213,426 | 7/1980 | Longhouse | 415/228 |
| 4,329,946 | 5/1982 | Longhouse | 415/914 |
| 4,505,641 | 3/1985 | Tsuchikawa et al. | 416/189 |
| 4,548,548 | 10/1985 | Gray, III | 416/189 |
| 4,685,513 | 8/1987 | Longhouse et al. | 416/189 |
| 4,781,298 | 10/1989 | Vera | 416/189 |
| 4,930,984 | 6/1990 | Kesel et al. | 416/189 |
| 5,183,382 | 2/1993 | Carroll | 416/189 |

FOREIGN PATENT DOCUMENTS

| | | |
|---|---|---|
| 267725 | 5/1988 | European Pat. Off. . |
| 2703352 | 8/1978 | Fed. Rep. of Germany . |

*Primary Examiner*—John T. Kwon

*Attorney, Agent, or Firm*—Sughrue, Mion, Zinn, Macpeak & Seas

[57] ABSTRACT

The profiled annular hoop for a fan helix blade tip exhibits a curved inlet collar whose convexity is directed towards the axis (100), and is characterized in that this collar (11) has a given axial length (*l*) and a meridian section (110) shaped approximately as a quarter ellipse whose eccentricity is of the order of 1.5 and whose major half-axis (*a*) lies between approximately one third and one half of this given axial length (*l*).

Application to cooling motorized fans of vehicle radiators.

11 Claims, 2 Drawing Sheets

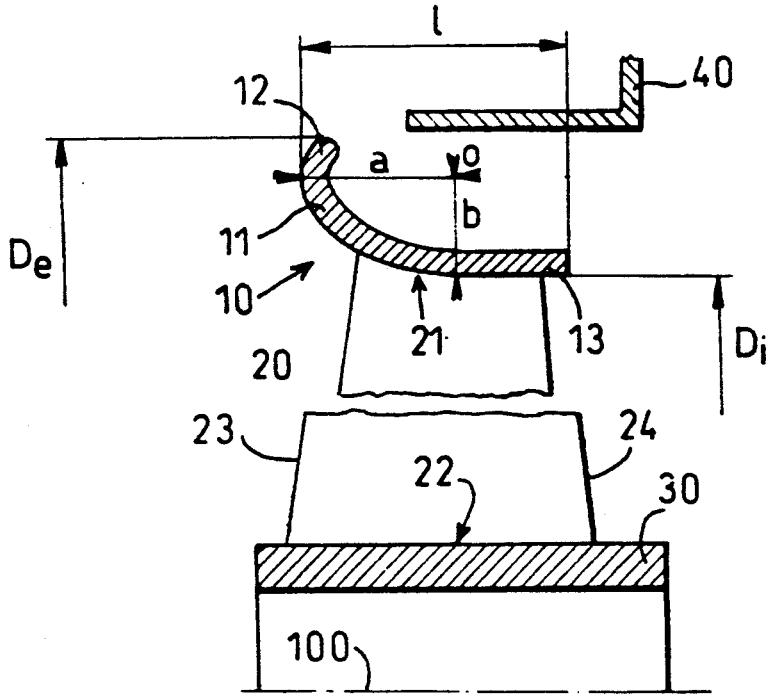
FIG. 1
FIG. 2A
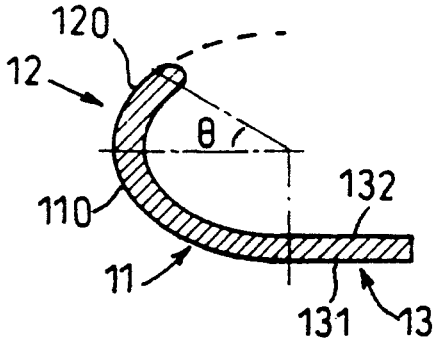
FIG. 2B
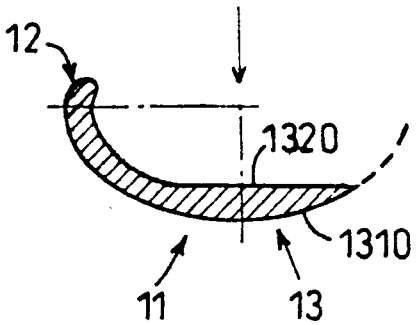
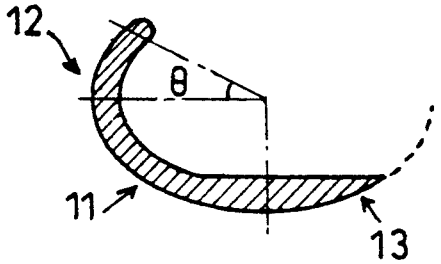
FIG. 2C

PROFILED ANNULAR HOOP FOR A FAN HELIX AND ITS APPLICATION TO VEHICLE MOTORIZED FANS

The present invention relates to cowl devices of helices, especially axial helices, for example for vehicle motorised fan units.

Various cowl profiles have already been proposed for hoops mounted on the tips of the fan helix blades. Amongst these profiles, in meridian section, is the arc to a circle which confers upon the helix a flared inlet to the rotating cowl or hoop, so as to minimise the flow separation of the thin streams of air flowing along the profile of the cowl.

However, around the inlet collar to such a hoop, there is usually formed a flow separation, stationary or otherwise, of the thin streams of air of greater or lesser amplitude, which detachment brings about degradation in aerodynamic performance of the parts at the blade tip.

Such a flow separation leads to the formation of vortices and interacts with the fluid layers covering the lower and upper surfaces of the blades. Particularly unfavourable flow conditions result therefrom, especially in the blade tip part, which introduce:

an additional loss of total fluid pressure, crossing the helix;

a noticeable increase in the operating noise level of the installation.

Solution examples according to the prior art are illustrated in the document U.S. Pat. No. 3,937,192. It will be observed, in particular, that such a solution imposes a significant clearance or spacing, of the order of about twenty millimeters, between the outer wall of the rotating annular hoop connected to the blade tips, and the inner wall of the stationary cowl or nozzles which face it.

However, this solution is not suitable for obtaining a true increase in helix performance.

The subject of the invention is a profiled annular hoop for fan helix blade tips exhibiting a curved inlet collar whose convexity is directed towards the axis. This hoop is characterised in that the collar has a given axial length and a meridian section shaped approximately as a quarter ellipse whose eccentricity is of the order of 1.5 and whose major half-axis lies between approximately one third and one half of this given axial length.

The subject of the invention is also the application of such a hoop to the manufacture of a helix for a motorised fan in a vehicle.

Other characteristics of the invention will emerge upon reading the description and the claims which follow, as well as from the examination of the appended drawing, given solely by way of example, in which:

FIG. 1 is a diagrammatic partial view of an embodiment of a hoop according to the invention;

FIGS. 2A, 2B, 2C are detailed partial meridian sections of embodiment variants of a hoop according to the invention;

Figure 3:
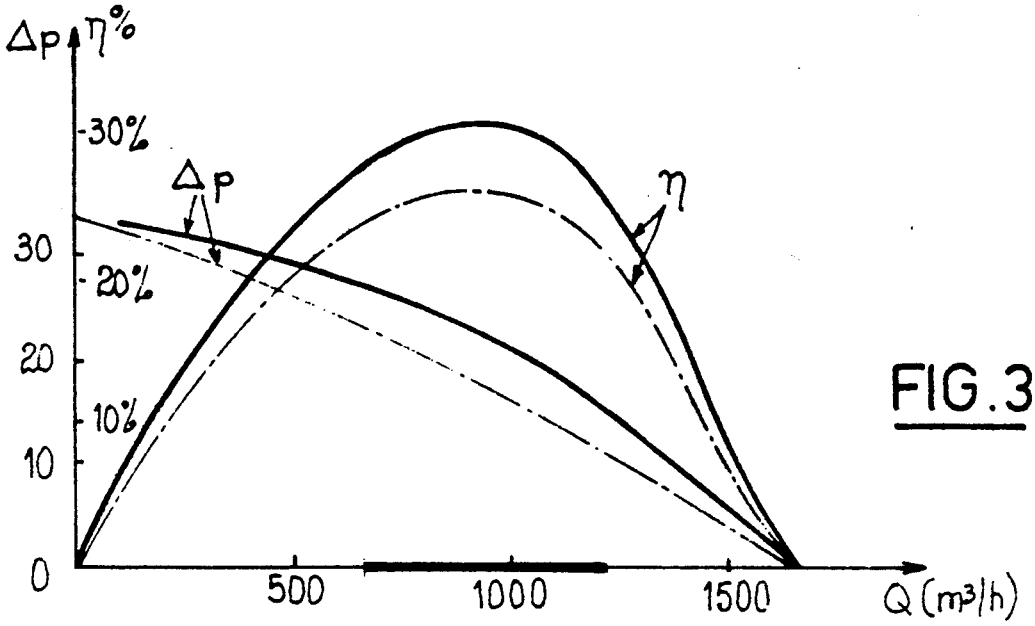
Figure 4:
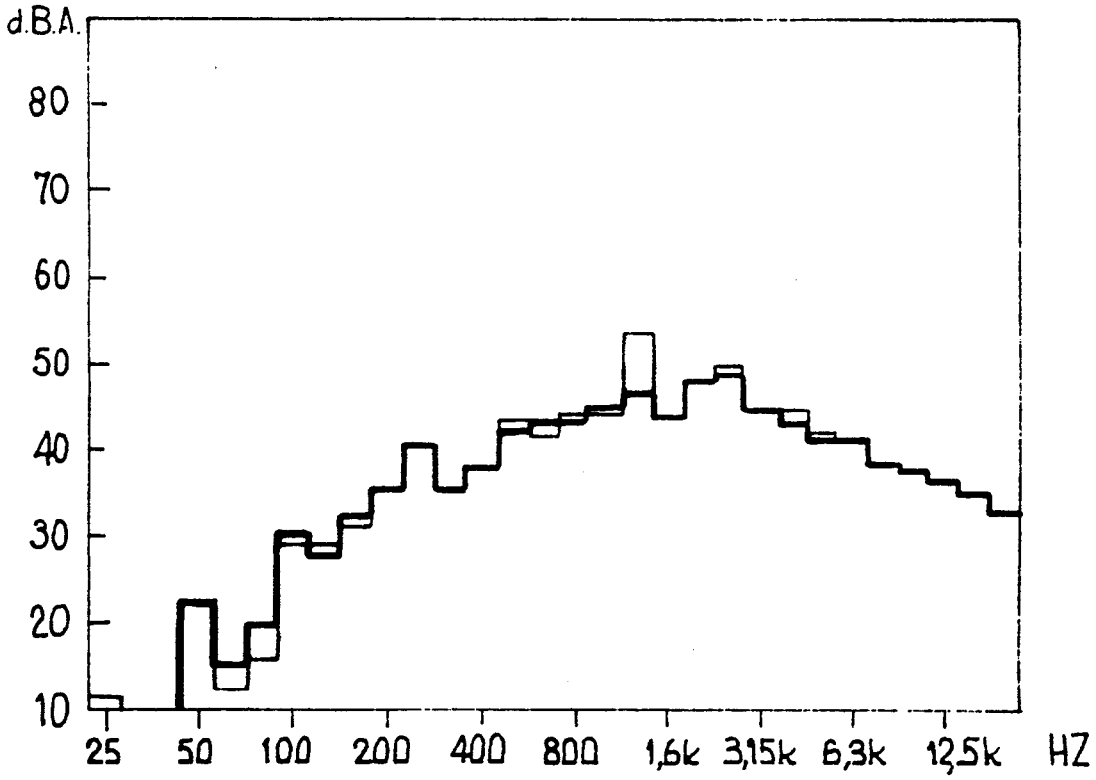

FIG. 3 illustrates comparative graphs of pressures and efficiencies, as a function of the flow rate, for a helix equipped with a conventional hoop (dot and dash line) and a helix equipped with a hoop according to the invention (heavy line); and FIG. 4 is a graph illustrating the result of normalised harmonic analysis, at a third of an octave and in class A, of the noise radiated by a helix equipped with a conventional hoop (thin line) and helix equipped with a hoop according to the invention (heavy line).

Since the fan helices, and more especially those for motorised fans in vehicles are well known in technology, the description which follows will only describe that which directly or indirectly relates to the invention. For the remainder, the specialist in the technology in question will draw upon the current conventional solutions at his disposal so as to deal with particular problems with which he is confronted.

In the description which follows, the same reference numeral always identifies a similar element, regardless of the embodiment or embodiment variant.

For convenience of the account, the various constituents of a profiled angular hoop according to the invention will be described successively before giving an account of its operation and its manufacture.

As can be seen, a profiled annular hoop 10 according to the invention is intended to be combined with the blades 20 of a fan helix. More especially, the hoop 10 is intended to be fixed to the tip 21 of each of the blades whose root 22 is carried by a hub 30 intended to be driven by a shaft of axis 100 of an electric motor (not represented). Each blade 20 also exhibits a leading edge 23 and a trailing edge 24.

As can be seen, the profiled annular hoop 10 has a curved inlet collar 11 whose convexity is directed towards the axis 100 in relation to which the helix rotates perpendicularly and with which it is coaxial. This collar 11 has a given axial length $l$ and has a meridian section 110 shaped approximately as a quarter ellipse. The eccentricity $e$ of this ellipse is defined, as is the convention, by the ratio of its major and minor half-axes $a$ and $b$ respectively, and is of the order of 1.5. The length of the major half-axis $a$ of this ellipse lies between about one third and one half of the given axial length $l$ of the collar.

As may be observed, the major axis of this ellipse is parallel to the axis 100 of the annular hoop 10.

The collar 11 is preferably equipped with a centrifugal frontal rim 12, as illustrated, whose angular amplitude $\theta$, measured from the centre $o$ of the ellipse from its major axis, does not exceed approximately 45°. Preferably, this rim 12 has a curved meridian section 120 which is approximately elliptical or even circular.

If need be, the collar 11 is equipped with a rear extension 13 which is delimited by an inner wall 131 facing the axis 100 and by an outer wall 132. Preferably, the inner wall 131 has a curved meridian section 1310 which is approximately elliptical or even circular. Preferably, the outer wall 132 has a rectilinear meridian section 1320 which is, for example, parallel to the axis 100 of the annular hoop. It is clear that the particular configurations belonging to the inner 131 and outer 132 walls can be adopted not simultaneously.

As is the convention, this hoop 10 according to the invention is intended to rotate preferably in a nozzle 40 of a cowl which is fixed. Such a nozzle is, for example, fixed to the front wall of a cooling radiator of a vehicle internal combustion engine or of an exchanger for a passenger compartment air-conditioning unit.

As can be observed in particular in FIGS. 2B and 2C, the thickness of the rear extension 13 of the hoop 10 is not constant, and thins down in the direction of air flow, from upstream to downstream.

For the comparative performance examples which follow, a profiled annular hoop according to the invention has been used whose given axial length $l$ is 32 Mm, whose ellipse has a major half-axis $a$ of 12 mm and a minor half-axis $b$ of 8 mm, whose maximum diameter $D_o$ measured at the front rim is 284 mn, whose inner diameter $D_1$ is 260 mm, and whose maximum thickness between the inner and outer walls is 3 mm.

An examination of the graphs clearly indicates that the helix equipped with a hoop according to the invention improves the ventilation efficiency whilst maintaining, or even reducing, the noise level under normal operating conditions. This harmonic analysis, at a third octave, in A-weighting, is conducted according to the accepted conventional test method in this field, on the suction side, in a soundproof chamber and in the free field, that is to say that the helix, provided with its hoop according to the invention and placed in its stationary cowl or nozzle, is only studied when it rotates at 2300 rpm (see FIG. 4). On the graphs of FIG. 3, the abscissa measures the flow rate Q and the ordinate measures the efficiency $\eta$ expressed as a percentage and the difference in static pressure $\Delta p$, between upstream and downstream, expressed in millimetres of water; the operating range is indicated as a heavy line on the abscissa axis.

It is clear that the elliptical configuration may be approximated by an osculating circular configuration. Likewise, the connections between the collar, front rim and rear extension are made so as to form a continuous surface, preferably without a marked angular zone; these connections are for example obtained by arcs to a circle.

Such a hoop may be manufactured from metal or synthetic material. When the latter type of material is used, such a hoop may therefore be moulded in one piece with the blades and the hub of a helix.

The preceding description shows all the import of and advantages provided by the invention especially when a hoop according to the invention is part of a helix for a motorised fan in vehicles.

I claim:

1. Profiled annular hoop for a fan helix blade tip exhibiting a curved inlet collar whose convexity is directed towards the axis (100), characterised in that this collar (11) has a given axial length ($l$) and a meridian section (110) shaped approximately as a quarter ellipse whose eccentricity is of the order of 1.5 and whose major half-axis ($a$) lies between approximately one third and one half of this given axial length ($l$).

2. Hoop according to claim 1, characterised in that the major axis ($2a$) of the ellipse is parallel to the axis (100) of the annular hoop (10).

3. Hoop according to claim 1 or 2, characterised in that the collar (11) is equipped with a centrifugal frontal rim (12) whose angular amplitude ($\theta$), measured from the centre (O) of the ellipse from its major axis ($2a$), does not exceed approximately 45°.

4. Hoop according to claim 3, characterised in that this rim (12) has a curved meridian section (120).

5. Hoop according to claim 4, characterised in that the meridian section (120) of the rim (12) is approximately elliptical or even circular.

6. Hoop according to claim 5, characterised in that the collar (11) is equipped with a rear extension (13).

7. Hoop according to claim 6, characterised in that the rear extension (13) has an inner wall (131) of curved meridian section (1310).

8. Hoop according to claim 7, characterised in that the curved meridian section (1310) of the inner wall (131) of the extension (13) is approximately elliptical or even circular.

9. Hoop according to claim 6, characterised in that the rear extension (13) has an outer wall (132) of rectilinear meridian section (1320).

10. Hoop according to claim 9, characterised in that the rectilinear meridian section (1320) of the outer wall (132) of the extension (13) is parallel to the axis (100) of the annular hoop (10).

11. The hoop according to claim 1, wherein the fan helix blade tip is part of a motorized fan in a vehicle.

* * * * *